US008078457B2

(12) United States Patent
Ghenania et al.

(10) Patent No.: US 8,078,457 B2
(45) Date of Patent: Dec. 13, 2011

(54) METHOD FOR ADAPTING FOR AN INTEROPERABILITY BETWEEN SHORT-TERM CORRELATION MODELS OF DIGITAL SIGNALS

(75) Inventors: Mohamed Ghenania, Lannion (FR); Claude Lamblin, Perros Guirec (FR)

(73) Assignee: France Telecom, Paris (FR)

( * ) Notice: Subject to any disclaimer, the term of this patent is extended or adjusted under 35 U.S.C. 154(b) by 951 days.

(21) Appl. No.: 11/919,065

(22) PCT Filed: Apr. 12, 2006

(86) PCT No.: PCT/FR2006/000805

§ 371 (c)(1),
(2), (4) Date: Nov. 13, 2007

(87) PCT Pub. No.: WO2006/114494

PCT Pub. Date: Nov. 2, 2006

(65) Prior Publication Data

US 2009/0299737 A1 Dec. 3, 2009

(30) Foreign Application Priority Data

Apr. 26, 2005 (FR) ..... 05 04191

(51) Int. Cl.
*G10L 19/00* (2006.01)

(52) U.S. Cl. ..... 704/219

(58) Field of Classification Search ..... 704/219–221
See application file for complete search history.

(56) References Cited

U.S. PATENT DOCUMENTS 6,173,257 B1 * 1/2001 Gao ..... 704/220
6,240,386 B1 * 5/2001 Thyssen et al. ..... 704/220
6,418,408 B1 * 7/2002 Bhaskar et al. ..... 704/219
6,434,519 B1 * 8/2002 Manjunath et al. ..... 704/205
2003/0115046 A1 * 6/2003 Zinser et al. ..... 704/219
2003/0125939 A1 * 7/2003 Zinser et al. ..... 704/219
2003/0135372 A1 * 7/2003 Zinser et al. ..... 704/258
2003/0144835 A1 * 7/2003 Zinser et al. ..... 704/219
2003/0195745 A1 * 10/2003 Zinser et al. ..... 704/219

(Continued)

OTHER PUBLICATIONS

Kyung Tae Kim et al: "An Efficient Transcoding Algorithm for G.723.1 and EVRC Speech Coders" VTC Fall 2001, IEEE 54th Vehicular Technology Conference, Proceedings, Atlantic City, NJ, Oct. 7-11, 2001, IEEE Vehicular Technology Converence, New York, NY: IEEE, US, vol. 1 of 4, 54, Oct. 7, 2001, pp. 1561-1564, XP010562224 ISBN: 0-7803-7005-8.

(Continued)

*Primary Examiner* — Michael N Opsasnick
(74) *Attorney, Agent, or Firm* — McKenna Long & Aldridge LLP

(57) ABSTRACT

The invention relates to the code conversion of digital signals, particularly voice signals, and in particular coding according to a second format from information obtained by carrying out a coding according to a first format. These first and second formats use LPC (linear predictive coding) short-term prediction models on digital signal sample blocks while using filters represented by respective LPC coefficients. The LPC coefficients of the second format are determined from an interpolation on the representative values of the LPC coefficients of at least the first format, between at least one given block and a preceding block. According to the invention, the interpolation (43), is dynamically effected while selecting (42), for each current block, at least one interpolation factor ($\alpha$) among a preselection of factors according to a predetermined criterion such as a stationarity criterion of the digital signal (41).

14 Claims, 6 Drawing Sheets

U.S. PATENT DOCUMENTS

2005/0053130 A1 3/2005 Jabri et al.

OTHER PUBLICATIONS

Seongho Seo et al. "A Novel Transcoding Algorithm for SMV and G.723.1 Speech Coders via Direct Parameter Transformation" Surospeech 2003, 8th European Conference on Speech Communication and Technology, Geneva, Switzerland, Sep. 2003, pp. 2861-2864, XP007006997, Geneva (CH).

* cited by examiner

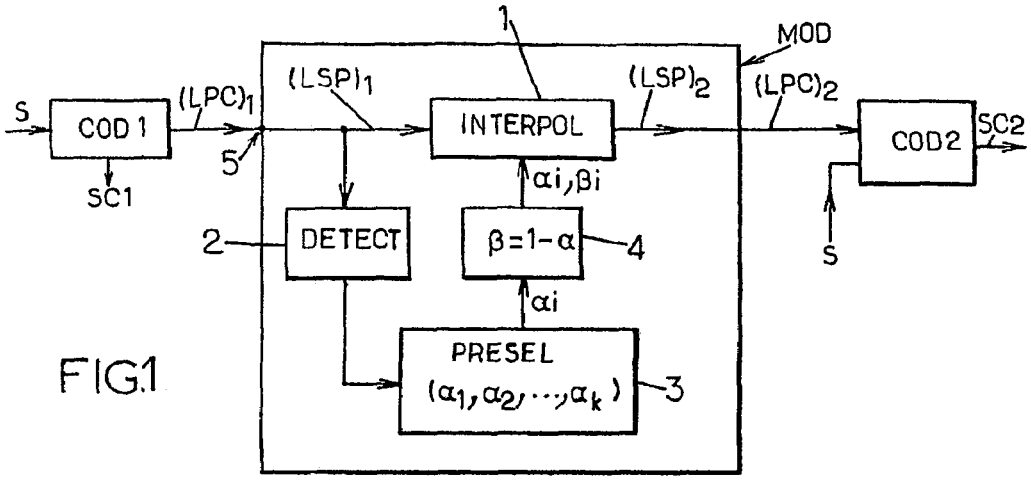
FIG.1
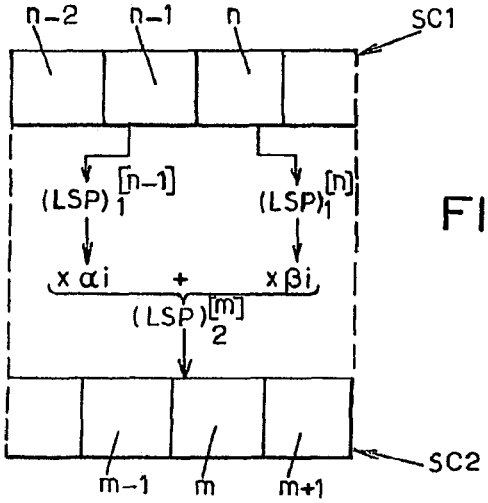
FIG.2
FIG.3A
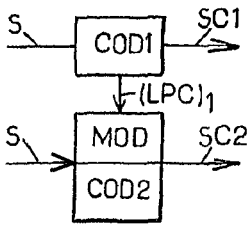
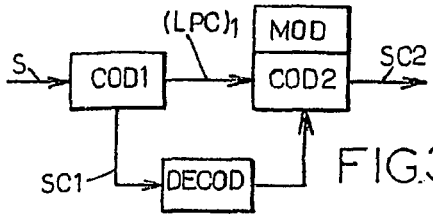
FIG.3B

FIG.4
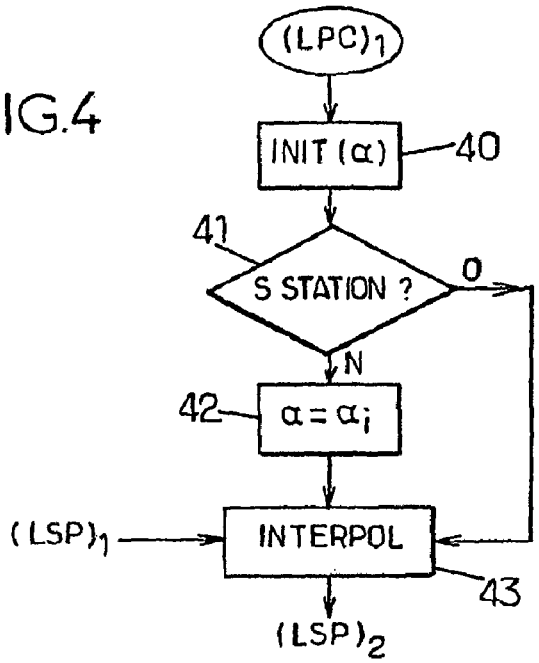
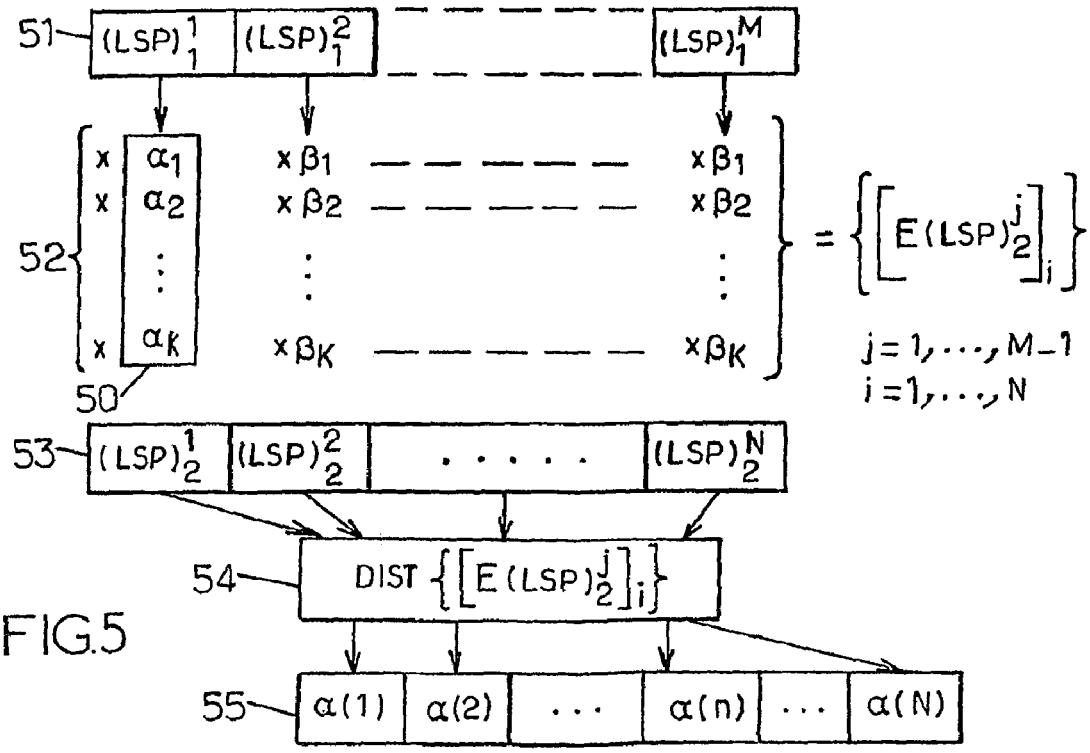
FIG.5

METHOD FOR ADAPTING FOR AN INTEROPERABILITY BETWEEN SHORT-TERM CORRELATION MODELS OF DIGITAL SIGNALS

This application claims priority from PCT/FR2006/000805 filed Apr. 12, 2006, which claims priority from French Application FR 05 04191, filed Apr. 26, 2005, both of which are hereby incorporated by reference in their entirety as if fully set forth herein.

FIELD OF THE DISCLOSURE

The invention relates to the coding/decoding of digital signals, particularly in applications for the transmission or storage of multimedia signals such as audio signals (speech and/or sound).

Its particular object is to effectively determine the parameters of a second short-term prediction model or LPC (for "Linear Predictive Coding") from the parameters of a first LPC model.

BACKGROUND

In the compression field, the coders use the properties of the signal such as its harmonic structure, used by long-term prediction filters, and its local stationarity, used by short-term prediction filters. Typically, the speech signal can be considered as a signal that is stationary, for example, over time slots of 10 to 20 ms. It is therefore possible to analyze this signal in blocks of samples called frames, after appropriate windowing. The short-term correlations can be modeled by linear filters varying in time whose coefficients are obtained using a linear-predictive analysis on frames of short duration (from 10 to 20 ms in the example cited above).

Linear predictive coding is one of the most commonly used digital coding techniques. It consists in performing an LPC analysis of the signal to be coded to determine an LPC filter, then in quantizing this filter on the one hand, and in modeling and coding the excitation signal on the other hand. This LPC analysis is performed by minimizing the prediction error on the signal to be modeled or a modified version of this signal. The autoregressive linear prediction model of order P consists in determining a signal sample at an instant n by a linear combination of the P past samples (principle of prediction). The short-term prediction filter, denoted A (z), models the spectral envelope of the signal:

$$A(z) = \sum_{l=0}^{P} -a_l \times z^{-l}$$

The difference between the signal at the instant n, denoted S(n), and its predicted value $\tilde{S}(n)$ constitutes the prediction error:

$$e(n) = S(n) - \tilde{S}(n) = S(n) + \sum_{l=1}^{P} a_l S(n-i)$$

The prediction coefficients are calculated by minimizing the energy E of the prediction error given by:

$$E = \sum_n e(n)^2 = \sum_n \left( S(n) + \sum_{l=1}^{P} a_l S(n-i) \right)^2$$

The resolution of this system is well known, in particular by the Levinson-Durbin algorithm or the Schur algorithm.

The coefficients $a_i$ of the filter must be transmitted to the receiver. However, these coefficients do not have good quantization properties, so transformations are preferably used. Among the most common are:

- the PARCOR coefficients (standing for "PARtial CORrelation" consisting of reflection coefficients or partial correlation coefficients),
- the log area ratios LAR of the PARCOR coefficients,
- the line spectral pairs LSP.

The LSP coefficients are now the ones used most commonly to represent the LPC filter because they are suitable for vector quantization. There are other equivalent representations of the LSP coefficients:

- LSF (Line Spectral Frequency) coefficients,
- ISP (Immittance Spectral Pair) coefficients,
- or even ISF (Immittance Spectral Frequency) coefficients.

Linear prediction uses the local quasi-stationarity of the signal. However, this local stationarity hypothesis is not always borne out. In particular, if the updating of the LPC coefficients is not done often enough, the quality of the LPC analysis is degraded. Increasing the frequency with which the LPC parameters are calculated obviously improves the quality of the LPC analysis by keeping better track of the spectral variations of the signal. However, this situation leads to an increase in the number of filters to be transmitted and therefore an increase in bit rate.

Furthermore, calculating the LPC parameters too frequently also raises a problem of complexity because determining the LPC parameters is costly in calculation complexity. Normally, it entails:

- windowing the signal,
- calculating the autocorrelation function of the signal on (P+1) values (P being the prediction order),
- determining from the autocorrelations the coefficients $a_i$, for example using the Levinson-Durbin algorithm,
- transforming them into a set of parameters having better quantization and interpolation properties,
- quantizing and interpolating these transformed parameters,
- and performing the reverse transformation.

For example, in the 8 kbit/s coder standardized by ITU-T G.729, a 10th order LPC analysis is performed every 10 ms (in blocks of 80 samples) and the module for extracting the LPC parameters constitutes almost 15% of the complexity of the 8 kbit/s G.729 coder. If a single analysis is performed for each 10 ms block, the G.729 coder uses an interpolation of the transformed LPC parameters to obtain LPC parameters every 5 ms.

In the ITU-T G.723.1 standardized coder, four 10th order LPC analyses are performed for each 30 ms frame, or one LPC analysis every 7.5 ms (in blocks called subframes of 60 samples), which represents 10% of the complexity of the coder. Nevertheless, to reduce the bit rate, only the parameters of the last subframe are quantized. For the first three subframes, an interpolation of the quantized parameters transmitted is used.

The complexity of the LPC analysis is critical when several codings need to be performed by one and the same processing unit such as a gateway responsible for managing numerous communications in parallel or a server distributing numerous multimedia contents. The complexity problem is further aggravated by the multiplicity of the compression formats of the signals circulating over the networks.

It will therefore be understood that a first problem arises relating to a bit rate/quality/complexity trade-off for the LPC analysis.

To offer mobility and continuity, modern and innovative multimedia communication services need to be able to operate in a wide variety of conditions. The dynamism of the multimedia communication sector and the multivendor nature of the networks, accesses and terminals have led to a proliferation of compression formats requiring, because of their presence in the communication chains, multiple codings either cascaded (code conversion) or in parallel (multiple-format coding or multimode coding).

Code conversion is necessary when, in a transmission chain, a compressed signal frame transmitted by a coder can no longer continue on its path in this format. The code conversion is used to convert this frame to another format compatible with the continuation of the transmission chain. The most basic solution (and the one most commonly used at the present time) is to place a decoder and a coder end to end. The compressed frame arrives in a first format. It is then decompressed. The decompressed signal is then recompressed in a second format accepted by the continuation of the communication chain. This cascade arrangement of a decoder and a coder is called a tandem. Such a solution is very costly in terms of complexity (mainly because of the recoding) and it degrades the quality because the second coding is done on a decoded signal which is a degraded version of the original signal. Moreover, a frame can encounter several tandems before arriving at its destination, bringing about a calculation cost and a loss of quality that are both significant. Furthermore, the delays introduced by each tandem operation are accumulated and can adversely affect the interactivity of the communications.

The complexity also poses a problem in the context of a multiple-format compression system where one and the same content is compressed in several formats. Such is typically the case with content servers that broadcast one and the same content in several formats suited to the access and network conditions and terminals of the various customers. This multiple-coding operation becomes extremely complex as the number of formats required increases, such that the resources of the system rapidly appear limited.

Another case of parallel multiple coding is multimode compression with a posteriori decision which is described as follows. On each signal segment to be coded, several compression modes are performed and the one that optimizes a given criterion or obtains the best bit rate/distortion trade-off is selected. Once again, the complexity of each of the compression modes limits their number and/or leads to the preselection of a very limited number of modes.

Thus, a second problem arises relating to the multiplicity of possible compression formats.

A few attempts from the prior art to resolve these problems are explained below.

Currently, most of these multiple-coding operations take no account of the interactions between the formats on the one hand, and between the format and its content on the other hand. However, some recent so-called "intelligent" code conversion techniques no longer limit themselves to decoding then recoding, but also use the similarities between coding formats and thus make it possible to reduce the complexity and the algorithmic delay while limiting the degradation. Similarly, it has been proposed to exploit the similarities between coding formats to reduce the complexity of the multiple parallel coding operations. For one and the same coding format parameter, the differences between coders lie in the modeling, the method and/or the frequency of calculation or even the quantization. Optimizing the parallel multiple coding of two LPC modelings has been given little study.

Typically, if a parameter is calculated and quantized in the same way by two coding formats respectively denoted A and B, the code conversion of the parameter is done at bit level by copying its bit field from the bitstream of the format A into the bitstream of the format B. If the parameter is calculated in the same way but quantized differently, it is normally essential to requantize it with the method used by the coding format B. Similarly, if the formats A and B do not calculate this parameter at the same frequency (for example, if their frame or subframe lengths are different), this parameter must be interpolated. It is possible to perform this step on the above-mentioned parameter only, without having to work back to the complete signal. The code conversion is then performed only at the parameter level. Moreover, the LSP coefficients are normally code-converted at this "parameter" level.

In the methods of the prior art, to obtain the LPC parameters of a second coding format from the parameters of a first coding format, it is normal to interpolate the LPC parameters of consecutive frames (or subframes) of the first format corresponding to the current frame (or subframe) of the second format. For example, a first method involves calculating the coefficients modeling the LPC filter of the second format for a frame, by interpolating the coefficients of the LPC filters of the second format roughly corresponding to this frame:

$$p_B(m)=\alpha p_A(n-1)+\beta p_A(n)$$

where $p_B(m)$ is the coefficients vector of the second model for its frame (m), $p_A(n)$ is the coefficients vector of the first model for its frame n, and $\alpha$ and $\beta$ are interpolation factors. Normally, $\beta$ is equal to $(1-\alpha)$.

For example, in the case of the code conversion between the coders TIA-IS127 EVRC and 3GPP NB-AMR, as described in:

"A novel Transcoding Algorithm for AMR and EVRC speech codecs via direct parameter Transformation", Seongho Seo et al., in Proc. ICASSP 2003, pp. 177-180, vol. II, the LSP coefficients at the frame m of the EVRC coder ($p_{EVRC}(m)$) are calculated by linearly interpolating the quantized LSP coefficients of the frames m and (m−1) of the AMR coder ($p_{AMR}(m)$ and $p_{AMR}(m-1)$), the interpolation factor ($\alpha$=0.84) being empirically chosen:

$$p_{EVRC}(m)=0.84p_{AMR}(m)+0.16p_{AMR}(m-1)$$

Conversely, the LSP coefficients at the frame m of the AMR coder are calculated by linearly interpolating the quantized LSP coefficients of the frames m and (m−1) of the EVRC coder (with $\alpha$=0.96):

$$p_{AMR}(m)=0.96p_{EVRC}(m)+0.04p_{EVRC}(m-1)$$

Here it has been proposed to also optimize the determination of the interpolation factors by a statistical study to take account of the differences in the characteristics of the two LPC analyses (analysis type, length and positioning of the analysis window, extension of the bandwidth applied to the autocorrelation coefficients, and so on).

This simpler case is often used when the two coding formats perform the LPC analysis at the same frequency. In the above example, the two coders perform an LPC analysis once every 20 ms frame. When the two coding formats do not perform the LPC analysis at the same frequency, it is routine to consider larger blocks of a duration that is a multiple common to the respective update times of the LPC parameters of the two formats. The choice of the two frames of the first format used for the interpolation, and the interpolation factors, then depend on the rank of a frame of the second format in this group of frames.

Thus, in the case of the code conversion from the ITU-T G.723.1 coder (30 ms frame) to the EVRC coder (20 ms frame), two G.723.1 frames correspond to three EVRC frames. This code conversion is described in particular in: "An efficient transcoding algorithm for G723.1 and EVRC speech coders", Kyung Tae Kim et al., in Proc. IEEE VTS 2001, pp. 1561-1564.

The choices of the two G.723.1 frames used for the interpolation, and the interpolation factors, depend on the rank of an EVRC frame in this group of three frames:

$$p_{EVRC}(3m)=0.5417p_{G.723.1}(2m-1)+0.4583p_{G.723.1}(2m+1)$$

$$p_{EVRC}(3m+1)=0.8750p_{G.723.1}(2m)+0.1250p_{G.723.1}(2m+1)$$

$$p_{EVRC}(3m+2)=0.2083p_{G.723.1}(2m)+0.7917p_{G.723.1}(2m+1)$$

Thus, in these LPC parameter code conversion techniques of the prior art, the set of interpolation factors is set according to the time position of the frame of the second format in its group of frames. Even the more complex code conversion methods, which involve more than two filters of the first format or even past filters of the second format, using a fixed set of interpolation factors.

This "fixed" interpolation leads to a wrong estimation of the filter of the second format in particular in the non-stationary areas. To remedy this, the present invention proposes to use an adaptive (or dynamic) interpolation.

SUMMARY

One object of the invention is to dynamically select a set of interpolation factors in a multiple coding context.

Another object of the invention is to limit the number of sets of interpolation factors, preferably by taking account of a desired quality/complexity trade-off and, for a given complexity, to optimize the quality or, conversely, to minimize the complexity for a given quality.

To this end, the invention first proposes a method of coding according to a second format from information obtained by carrying out at least one coding step according to a first format. The first and second formats use, in particular for coding a speech signal, LPC short-term prediction models on digital signal sample blocks, by using filters represented by respective LPC coefficients. In particular, in this method, the LPC coefficients of the second format are determined from an interpolation on values representative of the LPC coefficients of at least the first format, between at least one first given block and a second block, preceding the first block.

According to a currently preferred definition of the invention, the abovementioned interpolation is performed dynamically, by choosing for each current block at least one interpolation factor from a preselection of factors, according to a predetermined criterion.

The term "preselection" should be understood to mean a preconstituted set of interpolation factors which, by no means exclusively, can include sets of factors $\alpha$ and $\beta$ as defined above (pairs $\alpha$ and $\beta$, or even triplets $\alpha$, $\beta$ and $\gamma$ if it is decided to carry out the interpolation over three sample blocks respectively n, n−1 and n−2), or even of factors $\alpha$ only, in particular when a corresponding factor $\beta$ can be deduced from a factor $\alpha$ by a simple relation (for example of the type $\beta=1-\alpha$).

Thus, instead of using a fixed set of interpolation factors as in the prior art, the invention proposes to determine a set of several sets of interpolation factors and use, for each LPC analysis block, a set of interpolation factors selected from this preconstituted set.

This selection from the preconstituted set is performed dynamically according to the above-mentioned predetermined criterion. This predetermined criterion can advantageously relate to the detection of a break in stationarity of the digital signal between the given block and the preceding block.

The preselection can be constructed initially according to a heuristic choice or even from a preliminary statistical study, as will be seen in the detailed description below.

BRIEF DESCRIPTION OF THE DRAWINGS

Moreover, other characteristics and advantages of the invention will become apparent from studying the detailed description below, and the appended drawings in which:

FIG. 1 diagrammatically represents an exemplary code conversion module for implementing the invention, FIG. 2 diagrammatically illustrates the interpolation principle with a view to estimating the values representative of the LPC coefficients of the second format for a succession of blocks m−1, m, m+1 of the signal coded in the second format SC2, from an interpolation performed on the values representative of the LPC coefficients of the first format estimated for successive blocks n−2, n−1, n of the first coded signal SC1, FIGS. 3A and 3B diagrammatically illustrate, respectively, parallel coding and code conversion systems involving a code conversion module according to the invention, FIG. 4 is a flow diagram illustrating the general algorithm of a computer program product according to the invention, for dynamically choosing the interpolation factors from the preselection, FIG. 5 illustrates the preselection construction steps in an advantageous embodiment of the invention.

DETAILED DESCRIPTION OF THE EMBODIMENTS

Figure 6B:
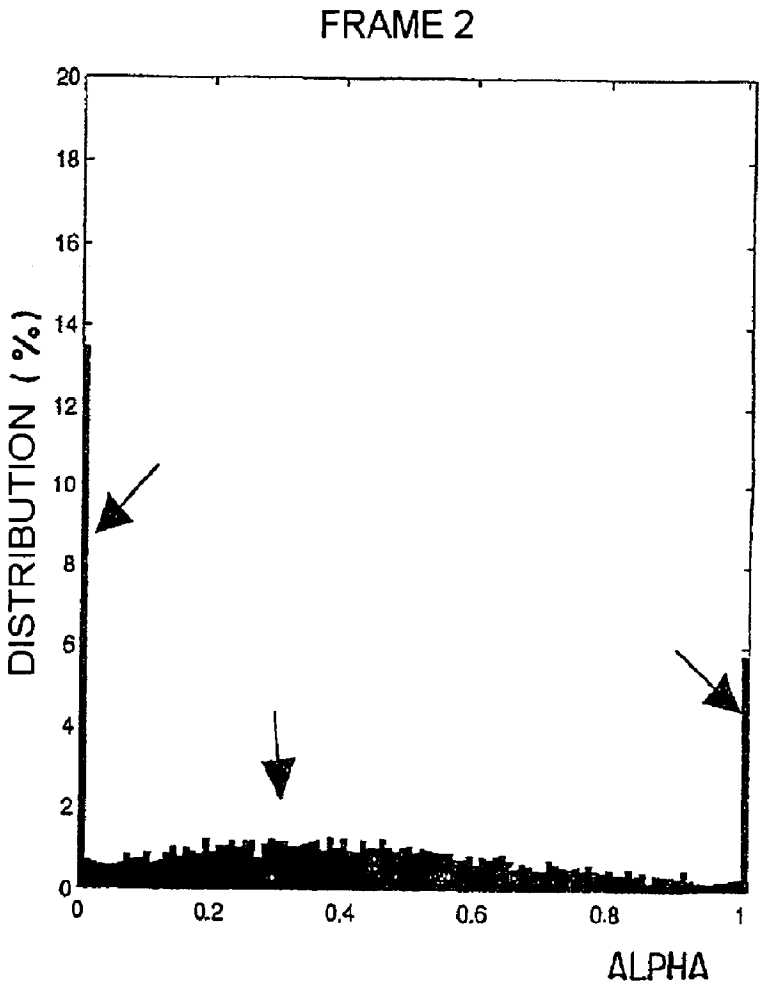
FIGS. 6A and 6B illustrate the histograms of the optimum value of the interpolation factor $\alpha$ respectively for the first two frames of the groups of three frames of the G.729 standardized coder, as the second coder.

Before discussing the embodiment details, it must be indicated that the invention, generally, also aims for a code conversion module one example of which is represented in FIG. 1. The code conversion module MOD can, for example, be arranged between:

- a first coder COD1 of an input signal S, according to a first format, and intended, for example, to deliver a first coded signal SC1, and
- a second coder COD2 of the same input signal S, according to a second format, and intended, for example, to deliver a second coded signal SC2.

In code conversion configuration, the first coder COD1 has started to code the input signal S, completely or partially, but, in any case, sufficiently to have already determined the LPC coefficients according to the first format. The code conversion module MOD according to the invention recovers at least the LPC coefficients obtained by the coding according to the first format, or values representative of these coefficients, for example the vectors $(LSP)_1$ and, from these values, estimates by interpolation the coefficients $(LPC)_2$ (or representative values $(LSP)_2$) which will be used by the second coder COD2 to construct the second coded signal SC2 in the second format. This measure then advantageously makes it possible to determine just once the LPC coefficients (in the first format) and, by a very simple interpolation calculation, to adapt them to the second coding format. The term "code conversion" then applies.

Thus, the code conversion module MOD according to the invention, generally, is adapted to code a signal S according to a second format, from information (including in particular the LPC coefficients obtained from the first coding or values representative of these coefficients, for example the vectors $(LSP)_1$) obtained by carrying out at least one coding step (the step for recovering the information including the values representative of the coefficients $(LPC)_1$) of the same input signal S according to the first format.

Naturally, these first and second formats use, in particular for coding a speech signal S, LPC short-term prediction models on digital signal sample blocks (as will be seen later with reference to FIG. 2), by using filters represented by respective LPC coefficients.

The module thus comprises:

- an input 5 (FIG. 1) for receiving information $(LPC)_1$ representative of the LPC coefficients obtained by the first format, and including, for example, the values $(LSP)_1$,
- and a processing unit (modules 1, 2, 3, 4 in FIG. 1) for determining the LPC coefficients of the second format (referenced $(LPC)_2$, or more particularly the values $(LSP)_2$ in FIG. 1 if the interpolation module 1 processes LSP vector values) from an interpolation (performed by the module 1 in FIG. 1) on values $(LSP)_1$ representative of the LPC coefficients obtained from the first format between at least one first given block (referenced n in FIG. 2) and a second block (reference n−1 in FIG. 2), preceding the first block n.

There now follows an explanation with reference to FIG. 2 of the general principle of such an interpolation. The signal coded in the first format SC1 comprises a succession of sample blocks n, n−1, n−2, etc. Values $(LSP)_1^{[n]}$, $(LSP)_1^{[n-1]}$, etc., representative of the LPC coefficients in the first format, have been obtained. The code conversion module applies an interpolation to these values, for example of the type $(LSP)_2^{[m]}=\alpha_i\ (LSP)_1^{[n-1]}+\beta_i\ (LSP)_1^{[n]}$, from interpolation factors $\alpha_i$ and $\beta_i$ chosen as described later, to obtain a value $(LSP)_2^{[m]}$ representative of an LPC coefficient in the second format for a current block m of the signal SC2 coded in the second format and corresponding to the block n. The signal SC2 coded in the second format also comprises a succession of sample blocks (also called "frames") referenced m−1, m, m+1 in FIG. 2.

According to the invention, the processing unit of the code conversion module performs this interpolation dynamically, by choosing for each current block n at least one interpolation factor $\alpha_1$ from a preselection (module 3) of factors $(\alpha_1, \alpha_2, \ldots, \alpha_K)$ according to a predetermined criterion. The predetermined criterion can typically be a criterion of continuity in the time of the signal S (or "stationarity" of the signal), or any other criterion of stability of the signal relative to one or more parameters linked to the signal S (gain, energy, long-term parameters LTP, period of the fundamental harmonic (or "pitch")), and preferably calculated by COD1. As a variant, it is possible to provide a signal proximity criterion.

In the example represented in FIG. 1, the input 5 of the code conversion module receives such parameters denoted $(LPC)_1$ which inform a module 2 for detecting a break in stationarity in the signal S. Moreover, the code conversion module MOD comprises a memory 3, typically addressable, and which stores a preselection of interpolation factors, denoted $(\alpha_1, \alpha_2, \ldots, \alpha_K)$ in the example shown. This notation means that, in the example described:

- an interpolation will be performed on the basis of two consecutive blocks n and n−1 and therefore two interpolation factors $\alpha_i$ and $\beta_i$ will be used on each current block m to be processed of the signal SC2, and
- the two factors $\alpha_i$ and $\beta_i$ are deduced simply from one another by a relation of the type $\alpha_i=1-\beta_i$, with $\alpha_i$ and $\beta_i$ both between 0 and 1.

However, naturally, as indicated above, this embodiment allows for numerous variants, in particular in terms of the number of successive blocks that will be used for the interpolation.

Here, a computation module 4 will determine the factor $\beta_i$ according to the chosen interpolation factor $\alpha_i$, by the simple relation $\alpha_i=1-\beta_i$ given above. The module 1 then constructs by interpolation on the vector values $(LSP)_1$ (on the blocks n and n−1), from these two factors $\alpha_i$ and $\beta_i$, the vectors $(LSP)_2$ representative of the LPC coefficients specific to the second format (referenced $(LPC)_2$) to constitute the second coded signal SC2.

The code conversion module MOD is useful both for multiple cascaded codings (called "code conversions"), and parallel multiple codings (called "multiple-codings" and "multimode" codings). The situation of the module MOD illustrated in FIG. 1 is a parallel configuration. The same applies for FIG. 3A, where one and the same input signal S feeds the two coders COD1 and COD2 in parallel, whereas the code conversion module MOD linked to the second coder COD2 receives from the coder COD1 the information $(LPC)_1$ useful for implementing the invention, in particular the values representative of the LPC coefficients obtained by the first coding format. The two coders separately deliver the two coded signals SC1 and SC2. The code conversion situation of FIG. 3B is substantially different in that the input signal S is received by the first coder COD1 only, which delivers to the code conversion module MOD the information (LPC)1 useful for implementing the invention. However, here, a module DECOD is provided for at least partially decoding the signal SC1 from the first coder COD1 and which feeds the second coder COD2.

The use of the code conversion module MOD is particularly advantageous here in that it is not necessary to completely decode the signal SC1 from the first coder, nor is it necessary to again apply all the steps for recoding in the second format.

The terms "intelligent code conversion" systems or "intelligent multiple coding" systems then apply (in particular for batteries of coders arranged in parallel).

The present invention also targets such systems, comprising:

a coder COD1 according to a first format and a coder COD2 according to a second format, using LPC short-term prediction models on digital signal sample blocks, by using filters represented by respective LPC coefficients, and a code conversion module MOD according to the invention, of the type described above.

In such systems, it seems advantageous to integrate this code conversion module MOD directly in the coder COD2 according to the second format (FIGS. 3A and 3B).

The invention also targets a computer program product, designed to be stored in a memory of a code conversion module of the type described above. With reference to FIG. 4 tracing its general algorithm, the computer program, when run on the module, then comprises instructions for:

determining (steps 43) values $(LSP)_2$ representative of the LPC coefficients of the second format from an interpolation on values $(LSP)_1$ representative of the LPC coefficients obtained from the first format between at least the given block n and the block n−1 preceding the given block n, and, in particular, dynamically performing this interpolation, by choosing (step 42) for each current block at least one interpolation factor $\alpha_i$ from a preselection of factors, according to a predetermined criterion (test 41).

In the embodiment represented for example in FIG. 4, this criterion can be associated with the stationarity of the signal and the test 41 detects any break in stationarity of the signal, on the basis of the information $(LPC)_1$ that is communicated to it for example by the first coder COD1. If a break in stationarity is actually detected (arrow N at the output of the test 41), the choice of the factor $\alpha$ is changed and the module chooses from the preselection the best factor $\alpha_i$ and performs the interpolation based on this factor $\alpha_i$. Otherwise (arrow O at the output of the test 41), the value of the factor $\alpha$, fixed in the initialization step 40 which takes place before the test 41, is retained.

Below is a description of examples as to the way in which the best factor $\alpha_i$ is chosen and how the preselection is initially constructed.

Examples of Construction of the Preselection $(\alpha_1, \alpha_2, \ldots, \alpha_k)$ There follows a description of how to determine the set of interpolation factors that constitutes the preselection on which the interpolation factors are chosen dynamically according to the invention.

In one embodiment option, the interpolation according to the invention can involve a first factor $\beta$ relating to a first given block (n) and a second factor $\alpha$ relating to a second block (n−1) preceding the first block. In a variant that remains within the framework of the present invention, it is possible to also make use of a third factor $\gamma$ relating to a block (n−2) again preceding the second block.

In the embodiment where only two factors $\alpha$ and $\beta$ are used, these first and second factors are advantageously deduced from each other by a relation of the type $\alpha=1-\beta$, these two factors preferably being between "0" and "1".

In a first embodiment, the abovementioned preselection can be initially set to include the value "0", the value "1" and at least one third value between "0" and "1", "0.5" for example.

Thus, in this embodiment, the set of interpolation factors and the size of this set can be determined heuristically. One basic example of heuristic choice is a set of size 3, composed of the values of $\alpha$ {0; 0.5; 1} (using the abovementioned relation $\beta=1-\alpha$).

In a second embodiment, more sophisticated than the first, the preselection of the interpolation factors is initially set following a preliminary statistical study, performed off line.

With reference to FIG. 5, preferably, to conduct this statistical study:

a) the following are constructed:

respective sets of values representative of LPC coefficients obtained by the first format (set 51) over a plurality of blocks M, and values representative of LPC coefficients obtained by the second format (set 53) over a plurality of blocks N, and a first set (50) of interpolation factors $(\alpha_1, \alpha_2, \ldots, \alpha_K)$ chosen to include the preselection according to the invention—to this end, the number of elements K to form this first set (50) is chosen to be sufficiently great, b) for each block n, from the first set 50, a better interpolation factor $\alpha(n)$ is determined according to a chosen criterion, notably a distance (step 54) between the interpolated values (set calculated in the step 52 and denoted $\{[E(LSP)_2^j]_i\}$ with j between 1 and M−1 and i between 1 and N) and the representative values (set 53) of the LPC coefficients obtained by the second format. There is thus obtained a second set 55 of interpolation factors $\alpha(n)$, of smaller size for example by eliminating the elements $\alpha(n)$ that are little or not at all invoked and by retaining the most redundant elements of this set. In complement or as a variant, it is also possible to limit the size of this set by grouping together those elements that are closest to each other about an average.

Figure 6A:
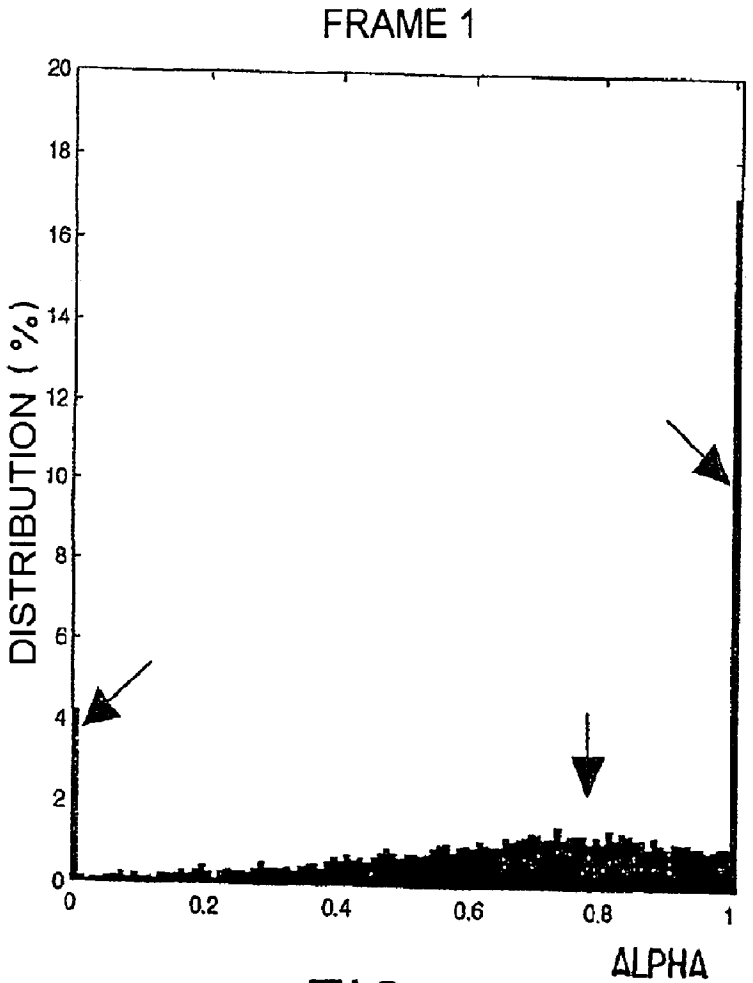

The reduction in the size of the set of interpolation factors $\alpha(n)$ can be based on the study of a histogram of the type illustrated in one of FIG. 6A or 6B. This type of histogram represents:

on the x axes, the K factors $(\alpha_1, \alpha_2, \ldots, \alpha_K)$ chosen initially arbitrarily, for example between 0 and 1 and spaced apart by a fixed interval of 0.01, and on the y axes, the number of occurrences associated with each factor $\alpha_1, \alpha_2, \ldots, \alpha_K$ and for which this factor has been determined as the best interpolation factor $\alpha(n)$ in the abovementioned step b).

The size of the set of interpolation factors $\alpha(n)$ can then be reduced by selecting the factors $\alpha_1, \alpha_2, \ldots, \alpha_K$ that have the most occurrences on the histogram (arrows in FIGS. 6A and 6B).

Moreover, it should be remembered that the "values representative of LPC coefficients $((LSP)_1, (LSP)_2)$" should be understood here to mean, for example, values of LSP (Line Spectral Pair, defined above) vectors, but not exclusively.

To further reduce the size of the second set obtained, the above step b) can advantageously be repeated with the second set, then with other successive subsets, until the abovementioned preselection is obtained.

A detail of the abovementioned second embodiment is given below, by way of example, based on a preliminary statistical study. For simplicity, the principles of the invention are illustrated in the case where the two formats perform their LPC analysis at the same frequency. Nevertheless, the invention also applies to the case of coding formats that do not perform their LPC analysis at the same frequency, as will be seen in an exemplary embodiment given below. The size of the set of values of a is chosen first and this set is determined by the statistical study, as follows.

Two sets of LPC coefficients, for example in the form of LSP ("Line Spectral Pair") vectors, obtained by the first coding format A $\{p_A(n)\}_{n=1,\ldots,N}$ and the second coding format B $\{p_B(n)\}_{n=1,\ldots,N}$ over a large number (N) of frames, are first constructed. In the case of a multiple coding, the two constructed sets correspond to the non-quantized LSPs of the two coders. In the case of a code conversion, the two sets correspond to the non-quantized LSPs of the format B and to the dequantized LSPs of the format A. A first set of $I_0$ factors $\{\alpha_i\}=_{i=I,\ldots,I_0}$ is also chosen. This set can comprise $I_0$ values ordered regularly in the range $[\alpha_1,\alpha_{I_0}]$, with $$a_i = a_1 + \frac{(i-1)}{(I_0-1)}(a_{I_0} - a_1)$$

(for example, 101 values ordered in steps of 0.01 in the range [0,1]).

For each block of index n, from this first set, the best factor denoted $\alpha(n)$ is determined according to a certain criterion. Preferably, $\alpha(n)$ is such that the vector $\tilde{p}_B(n)=\alpha(n)p_A(n-1)+(1-\alpha(n))p_A(n)$ interpolated from the vectors of the first format A is as close as possible to the vector $p_B(n)$ obtained by the second format. There are several distance criteria between two sets of LPC parameters conventionally used in LPC coding such as the mean square error (weighted or not) between two LSP vectors or the spectral distortion measurement calculated from the coefficients $\alpha_i$.

Referring, for example, to the histograms represented in FIGS. 6A and 6B, the study of the histogram of the $\alpha(n)$ "optima" makes it possible to reduce the size of the set according to the number of peaks in this histogram. This choice can obviously take account of the complexity constraints. Once this number $I_1$ has been chosen (in practice $I_1 \ll I_0$), the best set composed of $I_1$ values $\alpha$ is determined. Various methods can be used. It is possible, for example, to draw on classification methods by choosing as values of $\alpha$ the x axes of the $I_1$ peaks in the histogram, construct the classes by determining for each block the optimum value $\alpha(n)$ from the $I_1$ initial values, then, for each class, recalculate the optimum value of $\alpha$ and repeat the method according to step b) outlined in general terms above. Preferably, if the size of the set is small, a more "exhaustive" method is used, by calculating from the 11-uplet $[0,1]^{I_1}$ the best $I_1$-uplet $(\alpha_1,\ldots\alpha_{I_1})$ ordered $(\alpha_1<\ldots<\alpha_{I_1})$, by imposing a minimum difference (for example 0.01) between two consecutive $I_1$-uplet values. It is also possible to limit the study to the values in the vicinity of the x axes of the peaks in the histogram.

Dynamic Selection of the Set of Interpolation Factors

There now follows a description of how to dynamically select an appropriate set of interpolation factors, from the preselection obtained as described above.

In practice, once the set of the interpolation factors has been determined, forming the preselection described above, it is then necessary to define how to select a set of interpolation factors from this set, which amounts to determining, for each block of index n, its class.

As a general rule, the choice of an interpolation factor $\alpha$ from the preselection of factors, at least for each current block, is preferably performed beforehand.

In practice, in quantization, one simple way of working is to test all the sets of interpolation factors to select after the event the one that leads to the interpolated coefficients that are closest to the target coefficients (that is, the coefficients, for example of LSF type, to be quantized). In the multiple coding context, this post-selection, which entails determining the target parameters of the second format, is not applicable without losing much of the benefit of the so-called "intelligent" multiple coding methods, namely the reduced complexity brought about by the elimination of the modules for analyzing and extracting certain parameters.

In a multiple coding context, it then seems particularly advantageous to select the set of factors beforehand. This prior classification is performed according to a certain criterion, preferably a local stationarity criterion.

Thus, according to a preferred characteristic, the prior choice of an interpolation factor applies a prior classification based on a local stationarity criterion detected on the digital signal.

For example, the presence of a break in stationarity of the signal is first detected and, in the event of positive detection, the parameters of the two filters that must be given the greatest weight are then determined. The variations of certain selected parameters of the first format will advantageously be used to assess the stationarity criterion. For example, it is possible to use in particular the LPC coefficients obtained by the first coding format. Another example of parameters will be given in a later exemplary embodiment.

Quality/Complexity Trade-Off

Advantageously, the complexity of the method can be adjusted according to the desired quality/complexity trade-off (either the target complexity or the desired quality).

Depending on the quality/complexity trade-off, the determination of the set of interpolation factors will be more or less efficient (that is, more or less able to select the optimum set of factors). In a variant, to take account of the efficiency of the algorithm for selecting sets of factors, the interpolation factor values can be recalculated according to the classes constructed by the selection algorithm. It will therefore be understood that the procedures determining the set of interpolation factors and the associated classification can be repeated. It will also be noted that it is a good idea to adapt the size of all the sets of interpolation factors to the quality of the classification procedure: it is, in fact, unwise to use a fine dynamic interpolation (with a great many interpolation factors) if, for reasons of complexity, a basic classification procedure must be associated with it.

It will therefore be borne in mind that the number of elements in the preselection is chosen according to a predetermined quality/complexity trade-off, according to a preferred characteristic of the invention. Typically, the greater the number of parameters used to detect the break in stationarity, the greater also the number of elements in the preselection.

Exemplary Embodiment

The embodiment described below is for code conversion between two different coding formats, ITU-T G.729 and ITU-T G.723.1. A description of these two standardized coders is given first together with their LPC modelings.

8 kbit/s ITU-T G.729 and 6.3 kbit/s ITU-T G.723.1 Coders

These two coders belong to the well-known family of CELP coders, coders with synthesis analysis.

In such coders with synthesis analysis, the synthesis model of the reconstructed signal is used on the coder to extract the parameters modeling the signals to be coded. These signals can be sampled at the frequency of 8 kHz (300-3400 Hz telephone band) or a higher frequency, for example at 16 kHz for wideband coding (bandwidth from 50 Hz to 7 kHz). Depending on the application and the desired quality, the compression ratio varies from 1 to 16: these coders operate at bit rates from 2 to 16 kbit/s in the telephone band and at bit rates from 6 to 32 kbit/s in wideband mode.

In the CELP-type digital coding device, the coder with synthesis analysis most commonly used at the present time, the speech signal is sampled and converted into a series of blocks of L samples. Each block is synthesized by filtering a waveform extracted from a directory (also called dictionary), multiplied by a gain, through two filters varying in time. The excitation dictionary is a finite set of waveforms of L samples. The first filter is the long-term prediction filter. An "LTP" (for Long Term Prediction) analysis is used to assess the parameters of this long-term predictor which exploits the periodicity of the voiced sounds.

The second filter, which is of interest for the invention, is the short-term prediction filter. The "LPC" (Linear Prediction Coding) analysis methods make it possible to obtain these short-term prediction parameters, representative of the transfer function of the voice path and characteristic of the envelope of the signal spectrum. The method used to determine the innovation sequence is the synthesis analysis method: on the coder, a large number of excitation dictionary innovation sequences are filtered by the two filters LTP and LPC, and the selected waveform is the one that produces the synthetic signal closest to the original signal according to a perceptual weighting criterion, commonly known as the CELP criterion.

As for the decoding, this is much more complex than the coding. The bitstream generated by the coder enables the decoder after demultiplexing to obtain the quantization index of each parameter. The decoding of the parameters and the application of the synthesis model make it possible to reconstruct the signal.

The ITU-T G.729 coder works on a speech signal limited to the 3.4 kHz band and sampled at 8 kHz subdivided into 10 ms frames (80 samples). Each frame is divided into two subframes (numbered 0 and 1) of 40 samples (5 ms). A 10th order LPC analysis is performed every 10 ms (once for each frame) using the autocorrelation method with an asymmetrical window of 30 ms and a 5 ms "look-ahead" analysis. The first 11 autocorrelation coefficients of the windowed speech signal are first calculated to deduce from them the LPC coefficients by the so-called "Levinson" algorithm. These coefficients are then converted into the domain of line spectral pairs (LSP) in order for them to be quantized and interpolated. The quantization of the LSP values is performed by means of a 4th order switched predictive vector quantization on 18 bits. The coefficients of the linear prediction filter, quantized and non-quantized, are used for the second subframe, whereas for the first subframe, the LPC coefficients (quantized and non-quantized) are obtained by linear interpolation of the corresponding LSP values in the adjacent subframes (second subframes of the current frame and of the past frame in FIGS. 7A and 7B). This interpolation is applied to the LSP pair coefficients in the cosine domain.

The coefficients of the perceptual weighting filter are deduced from the linear prediction filter before quantization. The LSP coefficients, quantized and non-quantized, of the interpolated filters are reconverted into LPC coefficients in order to construct the synthesis and perceptual weighting filters for each subframe.

As for the ITU-T G.723.1 coder, it should be stated that the latter works on a speech signal limited in bandwidth to 3.4 kHz and sampled at 8 kHz divided into 30 ms frames (240 samples). Each frame comprises four subframes of 7.5 ms (60 samples) grouped in pairs in super-subframes of 15 ms (120 samples). For each subframe, a 10th order LPC analysis is performed by means of the autocorrelation method with a Hamming window of 180 samples centered on each subframe (for the last subframe, a 7.5 ms look-ahead analysis is therefore used). For each subframe, eleven autocorrelation coefficients are first calculated then, using the Levinson algorithm, the LPC coefficients are calculated. These non-quantized LPC coefficients are used to construct the perceptual weighting filter for each subframe. The LPC filter of the last subframe is quantized by means of a predictive vector quantizer. The LPC coefficients are first converted into LSP coefficients. The quantization of the LSPs is performed by means of a 1st order predictive vector quantization on 24 bits.

The LSP coefficients of the last subframe quantized in this way are decoded then interpolated with the decoded LSP coefficients of the last subframe of the preceding frame to obtain the coefficients of the first three subframes. These LSP coefficients are reconverted into LPC coefficients in order to construct the synthesis filters for the four subframes.

Determining LPC Parameters on a Code Conversion from the 6.3 kbit/s ITU-T G.723.1 Coder to the 8 kbit/s ITU-T G.729 Coder Here, the code conversion is done at the "parameter" level. The LSP coefficients of the second coding format are determined by dynamic interpolation of the LSP coefficients of the first dequantized coding format. The interpolated coefficients are then quantized by the method of the second format.

Figure 7A:
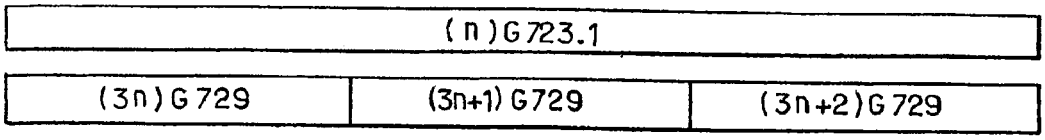
FIG. 7A illustrates the correlation between a frame of the G.723.1 standardized coder (30 ms), as the first encoder, and three frames of the G.729 standardized coder (10 ms), as the second coder.
Figure 7B:
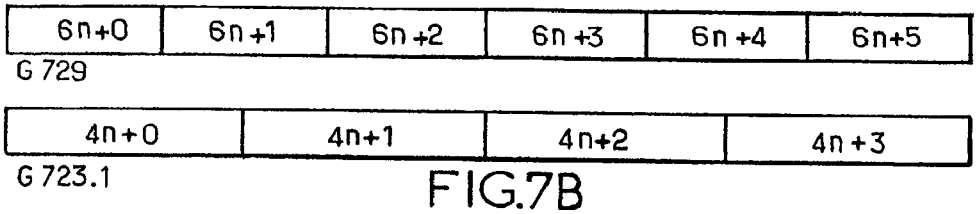
FIG. 7B illustrates the correlation between the subframes of the G.729 coder (5 ms) and the G.723.1 coder (7.5 ms)

As shown in FIG. 7A, if, conventionally, a common time origin is taken, one G.723.1 frame corresponds to three G.729 frames. FIG. 7B represents a G.723.1 frame and three G.729 frames and their respective subframes. It can therefore be seen that the G.729 subframes (5 ms) do not coincide with the G.723.1 subframes (7.5 ms).

The two formats do not perform their LPC analyses at the same frequency, so the set of the interpolation factors will depend on the rank of a G.729 frame in its group of three frames. These sets and their size are determined by a statistical study. A body of two sets of LSP vectors is formed, these sets being obtained by the G.723.1 coder $\{p_{G.723.1}(n)\}_{n=1,\ldots,N}$ and the G.729 coder $\{p_{G.729}(m)\}_{m=1,\ldots,3N}$ (N=9000), where $p_{G.723.1}(n)$ is the dequantized LSP vector of the frame n of the G.723.1 coder (frame length 30 ms) whereas $p_{G.729}(m)$ is the LSP vector to be quantized of the frame m of the G.729 coder (frame length 10 ms).

Initially, a set of 101 factors $\{\alpha_i\}$ is chosen, comprising 101 values ordered in the range [0,1] and evenly spaced apart by 0.01. For each frame of index (3n+i), in this set, the best factor is determined, denoted $\alpha(3n+i)$, such that the spectral distortion between the filter corresponding to $p_{G.729}(3n+i)$ and the interpolated filter (corresponding to $\tilde{p}_{G.729}(3n+i)=\alpha(3n+i)\,p_{G.723.1}(n-1)+(1-\alpha(3n+i))p_{G.723.1}(n)$) is minimal, in other words:

$$\alpha(3n+i) = \mathrm{Arg}\left(\min_{\alpha\in[0,1]} SD(p_{G.723.1}(n),\ \tilde{p}_{G.729}((3n+i),\alpha))\right)$$

The item taken up in this notation $\tilde{p}_{G.729}((3n+i),\alpha)$ roughly corresponds to the elements $\{[E(LSP)_2']_i\}$ of FIG. 5, simply specifying here that the best factors $\alpha(n)$ will be estimated by subframes, the subframes here being the sample blocks concerned.

Figure 8A:
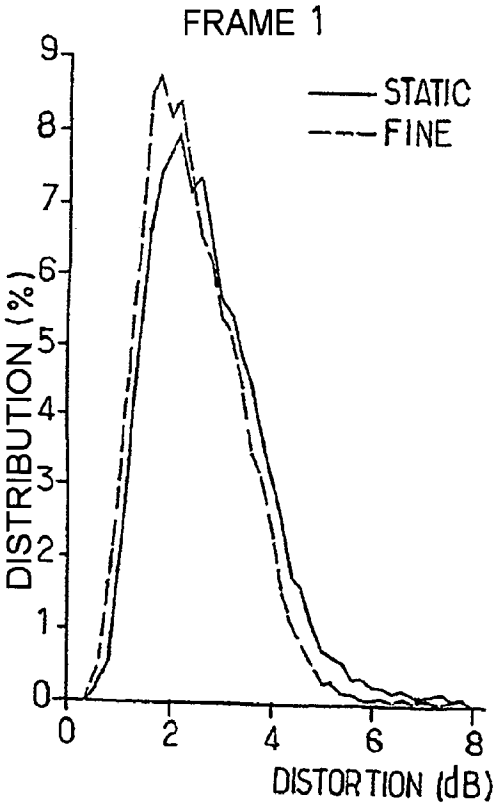
FIGS. 8A, 8B and 8C illustrate the distributions of the spectral distortions obtained by a static interpolation (solid line "Static" curve) as in the prior art and by fine dynamic interpolation according to the invention (broken line "Fine" curve), respectively for three current successive frames of the G.729 standardized coder, as the second coder.
Figure 8B:
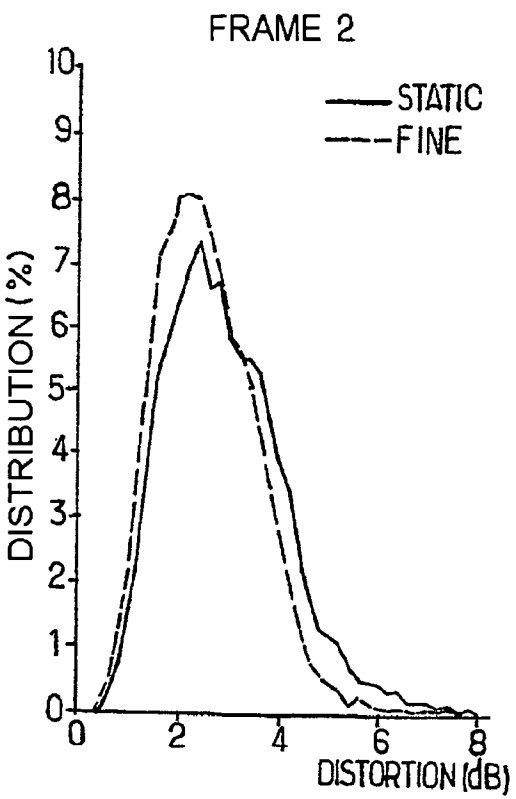
Figure 8C:
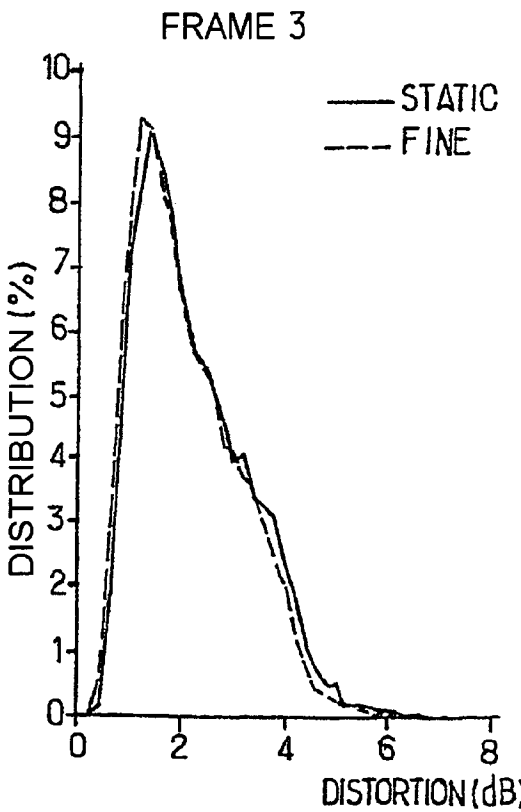

FIGS. 8A, 8B and 8C compare the distributions of the spectral distortions obtained by a static interpolation and the fine dynamic interpolation according to the invention. They clearly illustrate the improved performance levels brought about by the dynamic interpolation. The static interpolation factor depends on the rank of a G.729 frame (i=0, 1, 2) in a group of three frames. For a given index i, this fixed coefficient can be optimized to minimize the spectral distortion between the interpolated filter and the target filter. On the body, the fixed interpolation is given by:

$$\tilde{p}_{G.729}(3n)=0.77p_{G.723.1}(n-1)+0.23p_{G.723.1}(n)$$

$$\tilde{p}_{G.729}(3n+1)=0.36p_{G.723.1}(n-1)+0.64p_{G.723.1}(n)$$

$$\tilde{p}_{G.729}(3n+2)=0.02p_{G.723.1}(n-1)+0.98p_{G.723.1}(n)$$

Figure 9B:
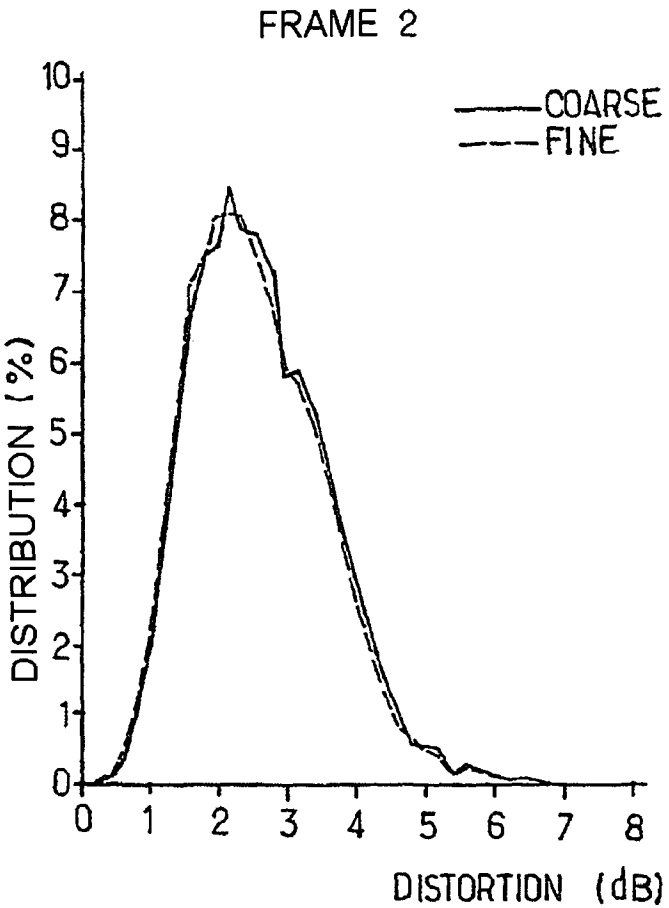
FIGS. 9A and 9B illustrate the distributions of the spectral distortions obtained by the fine (broken line "Fine" curve) and coarse (solid line "Coarse" curve) dynamic interpolations respectively for two current successive frames of the G.729 coder.
Figure 9A:
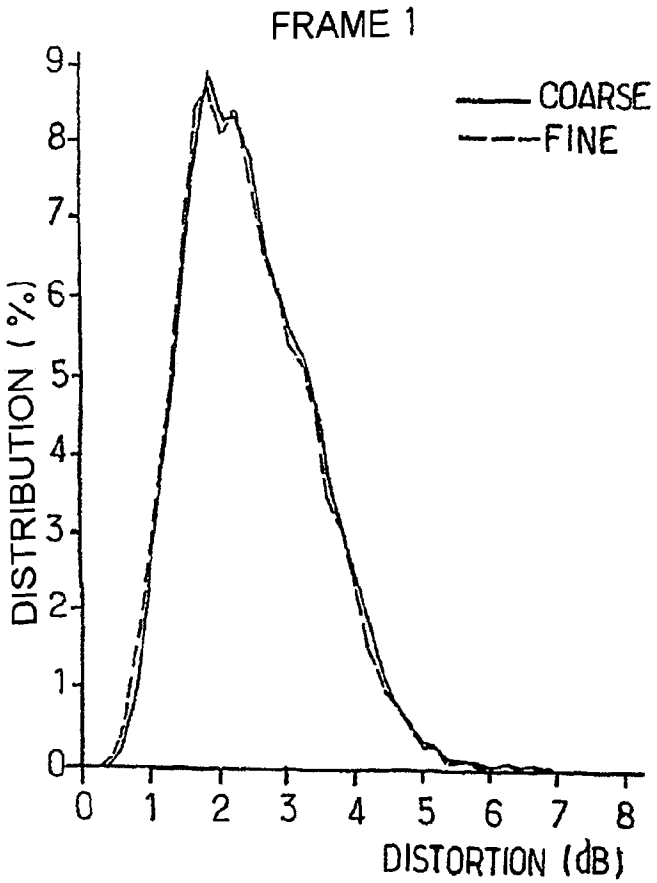

FIGS. 6A and 6B show the histogram of the distribution of the value of $\alpha(3n+i)$ for i=0 and 1 (the first two frames of each group of three frames). Examining the histogram of the $\alpha(3n+i)$ "optima" for a fine adaptive interpolation shows two peaks at the ends of the range [0,1] and another maximum (less marked) in the vicinity of the value of the static interpolation factor (the arrows indicate the maxima). A size of 3 is therefore chosen for the set of interpolation factors. Then, the best set consisting of three values $\alpha$ is determined, by a search among the triplets ordered about the vicinities of the x axes of the three peaks of the histograms. For the first (respectively second) frames of the group of three frames, the set of interpolation factors is: {0.24; 0.68; 0.98} (respectively 0.01; 0.39; 0.82}). FIGS. 9A and 9B show that the performance levels of this adaptive interpolation, even coarser, are close to those obtained by the fine adaptive interpolation and clearly better than those of the static interpolation.

The set of interpolation factors is then selected as follows.

Outside the preferred area about the value of the static interpolation factor, the distribution of the "optimum" factors $\alpha(3n+i)$ for a fine adaptive interpolation comprises two peaks at the ends of the range [0,1]. In most cases, these two extreme values correspond to non-stationary areas exhibiting a break in stationarity such as an attack or extinction. The procedure for selecting the set of interpolation factors from the three possible sets therefore consists in a first step for detecting a local break in stationarity using a stationarity criterion. Then, in the event of a positive detection, a determination is made as to whether the G.729 frame is before or after the break.

Figure 10:
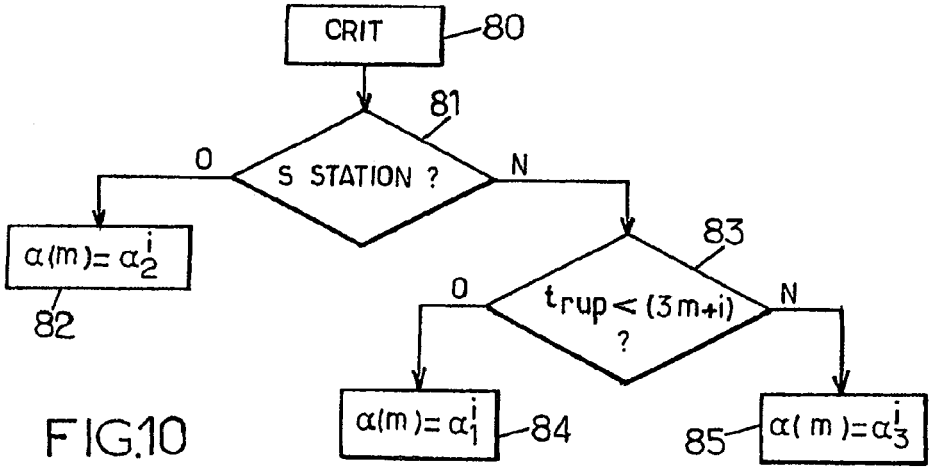
FIG. 10 is a flow diagram of one example of an algorithm for dynamically selecting interpolation factors $\alpha$.

FIG. 10 gives the simplified flow diagram of the algorithm for selecting the interpolation factor. The stationarity criterion is assessed in the step 80 and the test 81 distinguishes whether the signal is stationary or not. If it is stationary (arrow Y from the test 81), the value assigned to $\alpha(m)$ is the intermediary one $\alpha_2^i$ (step 82). Otherwise (signal not stationary—arrow N from the test 81), a test is carried out to determine:

- if the break occurs before the frame (3m+i) of the G.729 coder (arrow O from the test 83), in which case a factor $\alpha_1^i$ is assigned at the start of the histogram (step 84);
- if the break occurs after the frame (3m+i) of the G.729 coder (arrow N from the test 83), in which case a factor $\alpha_3^i$ is assigned at the end of the histogram (step 85).

Thus, it will be remembered, in more general terms and regardless of consideration of the frames or rather the subframes, that:

- a stationarity break instant (or area) is detected in the test 81—in fact, this break instant will typically be detected between a given block (n) and a preceding block (n−1) in the first coding format,
- in the test 83, the time position of a current block (m) of the second coding format, that needs to be processed, is compared with this detected break instant,
- and, in the interpolation, more weight is assigned to the LPC coefficients of the first format that are associated with the given block (n) (which corresponds to the step 85) if the block (m) of the second format is located after the break instant ($t_{rup}$), or to the LPC coefficients of the first format that are associated with the preceding block (n−1) (which corresponds to the step 84) if the block (m) of the second format is located before the break instant ($t_{rup}$).

More finely, this weight can take account of the relative temporal proximities of the blocks (n) and (n−1) relative to the block (m) and the break instant.

The variations of at least one parameter of the G.723.1 coder are advantageously used to assess the local stationarity. Several types of parameters can be used: such as the LSP vectors (or another LPC representation), the pitch periods, the fixed excitation gains, and so on. It is also possible to use other parameters calculated from the G.723.1 synthesis signal (such as the energy of this signal for each subframe). If the variations can be assessed by a simple mean square error (possibly weighted), it is also possible to use more sophisticated measures, for example, to estimate the trend of the path of the pitch by taking account of the multiples or submultiples. It is also possible to involve parameters extracted from the frames preceding the current G.729 frame. The choice of the number of criteria and their types depends on the desired quality/complexity trade-off. A multiple-criteria approach (based on the spectral distortion between two consecutive G.723.1 LPC filters, the trend of the path of the pitch and the energy variations of the G.723.1 synthesis signal in the subframes) can be used to accurately measure the local stationarity and, consequently, effectively select the best interpolation factor from the three. The detection is done by comparing the various stationarity measurements with thresholds. These thresholds are preferably determined using a statistical study of the distributions of the variation measurements obtained for the optimum classification.

To illustrate the variant that recalculates the set of interpolation factors to take account of the selection algorithm errors, there now follows a description of a simple embodiment based on a single criterion, for example the energy variations for each 5 ms block of the G.723.1 synthesis signal.

$E_l$ is used to denote the energy of the synthesis signal from the G.723.1 coder calculated on the 5 ms block corresponding to the second subframe of the G.729 frame 3n+i. For each G.729 frame 3n+i, two energy ratios $\rho_1^{(0)}$ and $\rho_1^{(1)}$ are calculated.

$$\rho_l^{(0)} = 1 - \left|2\frac{E_l}{E_l + E_{-1}} - 1\right| \text{ and } \rho_l^{(1)} = 1 - \left|2\frac{E_l}{E_l + E_2} - 1\right|$$

where $E_{-1}$ is the energy of the G.723.1 synthesis signal, calculated on the last 5 ms block of its preceding frame (frame (n−1)).

The algorithm for selecting the interpolation factor is as follows:

$$\alpha(3n+i)=\alpha^i_2$$

if ($\rho_1^{(0)}$<S and $\rho_1^{(1)}$>S'), $\alpha(3n+i)=\alpha^i_3$ else, if ($\rho_1^{(0)}$>S' and $\rho_1^{(1)}$<S), $\alpha(3n+i)=\alpha^i_1$ After a statistical study, the threshold values S and S' have been determined to favor the interpolation factor close to the static coefficient, which leads to a restriction on the use of the dynamic interpolation to the case where a break is clearly detected. As explained previously, the interpolation factors are recalculated according to the classification performed by this decision algorithm. In a variant, the dynamic interpolation procedure can be conservative, in which case the static interpolation factor is chosen as the average interpolation factor $\alpha^i_2$ and only the extreme factors ($\alpha^i_1$,$\alpha^i_3$) are optimized.

Of course, the present invention is not limited to the embodiment described above by way of example; it can be extended to other variants.

In practice, to remain concise, the above description is limited to the case where the LPC parameters of a current frame of the second format are determined by an adaptive interpolation of the LPC parameters of two consecutive frames of the second format. However, it will be understood that the invention can be applied to more complex interpolation schemes, involving, for example, more than two frames of the first format and/or, where necessary, other frames of the second format.

Thus, the method according to the invention is not limited to an embodiment whereby the LPC coefficients of the second format would be deduced from an interpolation on the LPC coefficients of the first format only. On the contrary, a variant that remains within the framework of the invention would consist in using the LPC coefficients of both the first and the second formats (possibly determined for preceding blocks) to perform the interpolation.

Moreover, the method according to the invention has been defined above as involving a given block (n) and at least one preceding block (n−1). This given block can be a current block, whereas the preceding block (n−1) is a past block. However, it will be understood that, as a variant, the interpolation can be performed on a current block (n) and a future block (n+1), if a delay is allowed in the processing according to the invention.

Similarly, the invention can apply to sample blocks other than the frames of the first or second format (for example subframes).

Finally, the representation of the LPC parameters by LSP vectors is given above solely as an example. Of course, the invention applies to other LPC representations.

The invention claimed is:

1. A method performed by a coder for coding a digital speech signal according to a second format of coding, from information corresponding to a first format of coding, comprising:

carrying out at least one coding step according to the first format of coding;

interpolating a value representative of a first plurality of linear predictive coding (LPC) coefficients corresponding to the first format, between a given block and a preceding block, which precedes the given block, to provide a second plurality of LPC coefficients corresponding to the second format, wherein the first and second formats use, LPC short-term prediction models on digital speech signal sample blocks, by using filters represented by the respective first and second pluralities of LPC coefficients, wherein the method further comprises:

a step of detection of a break in stationarity of the digital speech signal at least between the given block and the preceding block, a step of interpolation performed dynamically, by choosing for each current block at least one interpolation factor from a preselection of factors, according to said detection, and a step of transforming said digital speech signal into a coded signal according to said second format of coding, using said LPC coefficients of the second format obtained by said interpolation, and wherein:

a moment of break in stationarity is detected between a given block and a preceding block this break moment is compared with a time position of a current block in the second format, and, in the interpolation, more weight is assigned to the LPC coefficients of the first format that are associated with the given block if the block of the second format occurs after the detected break moment, or to the LPC coefficients of the first format that are associated with the preceding block if the block of the second format occurs before the detected break moment.

2. The method as claimed in claim 1, wherein the preselection is initially set to include the value "0", the value "1" and at least one third value between "0" and "1".

3. The method as claimed in claim 1, wherein the number of elements in said preselection is chosen according to a predetermined trade-off between quality and complexity.

4. The method as claimed in claim 1, wherein said interpolation applies a first factor relating to said given block and a second factor relating to said preceding block, and the first and second factors are deduced from each other.

5. The method as claimed in claim 4, wherein the first factor, represented by $\beta$, and the second factor, represented by $\alpha$, are between "0" and "1" and are deduced from each other by the relation $\alpha=1-\beta$.

6. The method as claimed in claim 1, wherein the choice of an interpolation factor from said preselection of factors, at least for each current block, is performed before interpolation.

7. The method as claimed in claim 6, wherein a prior choice of an interpolation factor applies a prior classification based on a local stationarity criterion detected on the chosen parameters, obtained by the first coding format.

8. The method as claimed in claim 1, wherein the preselection is initially set following a preliminary statistical study.

9. The method as claimed in claim 8, wherein the statistical study comprises:

respective sets of values representative of LPC coefficients obtained by the first format over a plurality of blocks, and of values representative of LPC coefficients obtained by the second format over a plurality of blocks; and a first set of interpolation factors chosen to include said preselection, wherein, for each block, from said first set, a revised interpolation factor is determined according to a chosen criterion, notably a distance between the interpolated values and the values representative of coefficients obtained by the second format, to obtain a smaller second set of interpolation factors.

10. The method as claimed in claim 9, wherein the step of determining the revised interpolation factor is repeated with said second set, then with other successive subsets, until said preselection is obtained.

11. A code conversion module, for coding a digital signal according to a second format, from information obtained by carrying out at least one coding of the signal according to a first format, the first and second formats using, for coding a speech signal, LPC short-term prediction models on digital signal sample blocks, by using filters represented by respective LPC coefficients, the module comprising:

an input for receiving information representative of the LPC coefficients obtained by the first format; and a processing unit for determining the LPC coefficients of the second format from an interpolation on values representative of the LPC coefficients obtained from the first format between at least one first block and a second block, preceding the first block, wherein the processing unit performs a detection of a break in stationarity of the digital signal at least between the given block and the preceding block, and the processing unit performs said interpolation dynamically, by choosing for each current block at least one interpolation factor from a preselection of factors, according to said detection, and wherein:

the processing unit detects a moment of break in stationarity between a given block and a preceding block, this break moment is compared with a time position of a current block in the second format, and, in the interpolation, more weight is assigned to the LPC coefficients of the first format that are associated with the given block if the block of the second format occurs after the detected break moment, or to the LPC coefficients of the first format that are associated with the preceding block if the block of the second format occurs before the detected break moment.

12. A non-transitory computer storage medium storing a computer program product, designed to be stored in a memory of a code conversion module, to code a signal according to a second format, from information obtained by carrying out at least one coding of the same signal according to a first format, the first and second formats using, for coding a speech signal, LPC short-term prediction models on digital signal sample blocks, by using filters represented by respective LPC coefficients, the computer program comprising the steps of:

determining values representative of the LPC coefficients of the second format from an interpolation on values representative of the LPC coefficients obtained from the first format between at least one first given block and a second block, preceding the first block; and dynamically performing said interpolation, by choosing for each current block at least one interpolation factor from a preselection of factors, according to a detection of a break in stationarity of the digital signal at least between the given block and the preceding block, and wherein:

a moment of break in stationarity is detected between a given block and a preceding block, this break moment is compared with a time position of a current block in the second format, and, in the interpolation, more weight is assigned to the LPC coefficients of the first format that are associated with the given block if the block of the second format occurs after the detected break moment, or to the LPC coefficients of the first format that are associated with the preceding block if the block of the second format occurs before the detected break moment.

13. A signal coding system for a speech signal, comprising:

a coder according to a first format and a coder according to a second format, using LPC short-term prediction models on digital signal sample blocks, by using filters represented by respective LPC coefficients; and a code conversion module for adapting the coding of the signal to the second format, from information obtained by carrying out the coding of the same signal according to the first format, wherein the module includes:

an input for receiving information representative of the LPC coefficients obtained by the first format; and a processing unit for determining the LPC coefficients of the second format from an interpolation on values representative of the LPC coefficients obtained from the first format between at least one first given block and a second block, preceding the first block, wherein the processing unit performs a detection of a break in stationarity of the digital signal at least between the given block and the preceding block, and the processing unit performs said interpolation dynamically, by choosing for each current block at least one interpolation factor from a preselection of factors, according to said detection, and wherein:

the processing unit detects a moment of break in stationarity between a given block and a preceding block, this break moment is compared with a time position of a current block in the second format, and, in the interpolation, more weight is assigned to the LPC coefficients of the first format that are associated with the given block if the block of the second format occurs after the detected break moment, or to the LPC coefficients of the first format that are associated with the preceding block if the block of the second format occurs before the detected break moment.

14. The system as claimed in claim 13, wherein said module is integrated in the coder according to the second format.

* * * * *